US009188918B1

(12) United States Patent
Ishii

(10) Patent No.: US 9,188,918 B1
(45) Date of Patent: Nov. 17, 2015

(54) IMAGE FORMING APPARATUS, CONTROL METHOD AND NON-TEMPORARY RECORDING MEDIUM

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroshi Ishii, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/551,288

(22) Filed: Nov. 24, 2014

(51) Int. Cl.
*G03G 15/20* (2006.01)
*G03G 15/00* (2006.01)

(52) U.S. Cl.
CPC ..... *G03G 15/205* (2013.01); *G03G 15/6573* (2013.01)

(58) Field of Classification Search
CPC ..... G03G 15/2046; G03G 15/205; G03G 15/6573
USPC ..... 399/67, 69
See application file for complete search history.

(56) References Cited

FOREIGN PATENT DOCUMENTS

JP 08-137130 5/1996

*Primary Examiner* — Erika J Villaluna
(74) *Attorney, Agent, or Firm* — Amin, Turocy & Watson, LLP

(57) ABSTRACT

In accordance with an embodiment, an image forming apparatus, comprises an image forming section configured to include at least one decolorable toner and at least one non-decolorable toner, and form a toner image selectively using the decolorable toner and the non-decolorable toner; a mode determination section configured to determine, from a plurality of image forming modes including a first image forming mode in which a toner image is formed on a sheet with one decolorable toner and a second image forming mode in which a toner image is formed on a sheet with two or more toners of the decolorable toner and the non-decolorable toner, a designated image forming mode; and a preheating control section configured to execute the preheating of the sheet before image formation in the second image forming mode, and execute no preheating of the sheet before image formation in the first image forming mode.

9 Claims, 8 Drawing Sheets

IMAGE FORMING APPARATUS, CONTROL METHOD AND NON-TEMPORARY RECORDING MEDIUM

FIELD

Embodiments described herein relate generally to an image forming apparatus, a control method and a non-temporary recording medium.

BACKGROUND

There is a decolorable toner having a characteristic of decoloring a color at a certain temperature (hereinafter referred to as a "decoloring temperature"). In response to the growing social awareness of environmental protection in recent years, an apparatus, which serves as both an image forming apparatus and an image decoloring apparatus and is capable of reusing paper printed with decolorable toner, has been developed. Moreover, the development of the hybrid type apparatus, which serves as both an image forming apparatus and an image decoloring apparatus and can print an image with one or both of the decolorable toner and the toner that cannot be decolored, has been developed. Hereinafter, the toner that cannot be decolored is described as a non-decolorable toner.

Incidentally, the image forming apparatus includes a fixing device for fixing toner on a sheet. The fixing device fixes the toner on the sheet by heating and pressing the sheet to which the toner is transferred. The fixing device, which includes rollers for heating and pressing the sheet, heats the rollers to a temperature (hereinafter referred to as a "set temperature") required for fixing the toner on the sheet. Generally, it is necessary to raise the set temperature required for the fixing process with the increase in the amount of the toner fixed on the sheet. In addition, when the binder resin to be used in the non-decolorable toner and the decolorable toner are different from each other according to the difference of the pigment, there is also a case where the fixing temperature of the non-decolorable toner is higher than that of the decolorable toner. As a result, in a printing process after fixing the decolorable toner and the non-decolorable toner on a single sheet at the same time, the set temperature is increased to be close to the decoloring temperature of the decolorable toner, and therefore, the color of the decolorable toner may be decolored. In addition, if the set temperature is set to be lower to avoid the decoloring of the toner, there is a possibility that the fixing failure of the toner is generated.

Further, in a color printing of the decolorable toner or a color printing of the non-decolorable toner, other than in the case in which the decolorable toner and the non-decolorable toner are fixed on the sheet at the same time, the set temperature is also set to be higher. In this way, after setting the set temperature to be higher and having finished the color printing, in a case of desiring to print with a monochrome decolorable toner, similar to the case described above, there is a problem that the color of the decolorable toner will be decolored.

DETAILED DESCRIPTION

In accordance with an embodiment, an image forming apparatus, which forms an image according to an image forming mode, comprises an image forming section, a transfer section, a fixing section, a fixing control section, a mode determination section and a preheating control section. The image forming section is provided with at least one decolorable toner and at least one non-decolorable toner, and forms a toner image selectively using the decolorable toner and the non-decolorable toner. The transfer section transfers the toner image formed by the image forming section to a sheet. The fixing section fixes the toner image on the sheet by heating and pressing the toner image. The fixing control section controls a set temperature of the fixing section. The mode determination section determines, from a plurality of image forming modes including a first image forming mode in which a toner image is formed on a sheet with one decolorable toner and a second image forming mode in which a toner image is formed on a sheet with two or more toners of the decolorable toner and the non-decolorable toner provided in the self-device, a designated image forming mode. The preheating control section executes the preheating of the sheet before image formation in the second image forming mode, and does not execute the preheating of the sheet before image formation in the first image forming mode.

Hereinafter, an image forming apparatus according to the embodiment is described with reference to the accompanying drawings.

A First Embodiment

Figure 1:
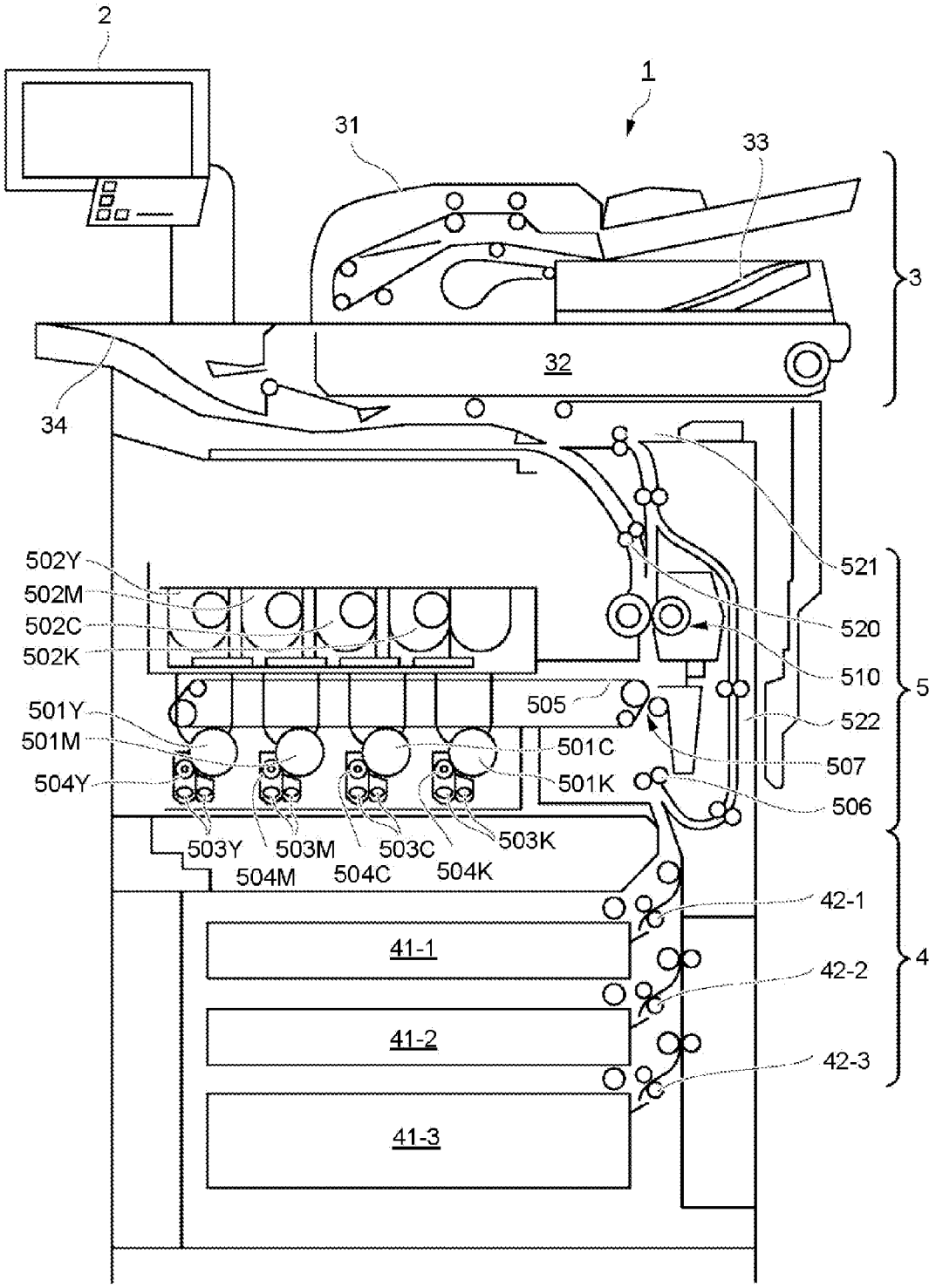
FIG. 1 is a perspective view illustrating an example of the internal constitution of an image forming apparatus 1 according to a first embodiment.

FIG. 1 is a perspective view illustrating an example of the internal constitution of an image forming apparatus 1 according to the first embodiment.

The image forming apparatus 1 is an image forming apparatus which is capable of forming a toner image formed with one or both of the decolorable toner and the non-decolorable toner on a sheet. For example, the image forming apparatus 1 is an MFP (multi-function peripheral). The image forming apparatus 1 includes, for example, a printer function, a copy function, a scan function and the like. The image forming apparatus 1 carries out color printing, for example, in a tandem method.

The image forming apparatus 1 includes an operation section 2, a scanner section 3, a sheet feed section 4 and a print section 5.

The operation section 2 receives an input operation from a user to input the input information to the image forming apparatus 1. The input information contains, for example, the information indicating either color printing or monochrome printing, the information indicating whether to use the decolorable toner, the information indicating either simplex printing or duplex printing and the like.

The scanner section 3 reads an image on the sheet through a scanning optical system to generate image data, and then outputs the generated image data to the print section 5. Hereinafter, the reading target sheet is referred to as a "document" so as to be distinguished from the sheet on which the image data is to be printed. Specifically, the scanner section 3 comprises an auto feed section 31, a reading section 32, and a document discharge tray 33. The auto feed section 31 guides the document to the reading section 32. The auto feed section 31 further feeds the document that has been read from the reading section 32 to the document discharge tray 33. The reading section 32 reads the document through the scanning optical system to generate image data, and then outputs the image data to the print section 5.

The sheet feed section 4, which is a tray for stacking the sheet formed with the toner image, feeds the sheet to the print section 5 in response to the execution of the printing processing. Specifically, the sheet feed section 4 includes cassettes 41-1, 41-2 and 41-3, and pickup rollers 42-1, 42-2 and 42-3. The pickup roller 42-1 picks up the sheet from the cassette 41-1. Similarly, the pickup roller 42-2 picks up the sheet form the cassette 41-2. The pickup roller 42-3 picks up the sheet form the cassette 41-3. Each of the pickup rollers 42-1, 42-2 and 42-3 sends the picked up sheet to a conveyance path. The sheet sent to the conveyance path is conveyed in a given conveyance direction by a plurality of roller pairs to be fed to the print section 5.

The print section 5 forms a toner image on the sheet based on the image data output from the scanner section 3. Specifically, the print section 5 is provided with photoconductive drums 501Y-501K, cartridges 502Y-502K, mixers 503Y-503K, developing rollers 504Y-504K, an intermediate transfer belt 505, a register roller 506, a secondary transfer section 507 (transfer section), a fixing device 510 (fixing section) and a sheet discharge roller 520.

For example, the image data output from the scanner section 3 is represented by R, G and B (R: red, G: green, B: blue). In this case, the image data is converted into the image data represented by Y, M, C and K (Y: yellow, M: magenta, C: cyan, K: black) through an image processing and then is input to the print section 5. The print section 5 also comprises a writing section consisting of a laser, an LED (Light Emitting Diode) and the like. The writing section forms an electrostatic latent image on each of the photoconductive surfaces of the photoconductive drums 501Y, 501M, 501C and 501K based on the image data. Herein, the photoconductive drum 501Y is the photoconductive drum corresponding to the image data represented by yellow. Similarly, the photoconductive drum 501M is the photoconductive drum corresponding to the image data represented by magenta, the photoconductive drum 501C is the photoconductive drum corresponding to the image data represented by cyan, and the photoconductive drum 501K is the photoconductive drum corresponding to the image data represented by black.

The cartridges 502Y-502K supply the toner to the mixers. The cartridge 502Y is filled by yellow toner and supplies the toner therein to the mixer 503Y. Similarly, the cartridge 502M supplies the magenta toner to the mixer 503M. The cartridge 502C supplies the cyan toner to the mixer 503C. The cartridge 502K supplies the black toner to the mixer 503K. Only the cyan toner filled in the cartridge 502C within the cartridges 502Y-502K is the decolorable toner.

The mixers 503Y-503K add the carrier to the toner and stir it, and then supply the stirred toner to the developing roller. The mixer 503Y supplies the toner to the developing roller 504Y. Similarly, the mixers 503M-503K supply the toners to the developing rollers 504M-504K, respectively.

The developing rollers 504Y-504K supply the toner to the photoconductive drums of which the photoconductive surfaces where the electrostatic latent images are formed. The developing roller 504Y supplies the toner to the photoconductive drum 501Y. Similarly, the developing rollers 504M-504K supply the toners to the photoconductive drums 501M-501K, respectively. In this way, the electrostatic latent images formed on the photoconductive surfaces of the photoconductive drums 501Y-501K are visualized.

As described above, the toner images formed on the photoconductive drums 501Y-501K are transferred (primarily transferred) to the belt surface of the intermediate transfer belt 505. The register roller 506 sends the sheet conveyed from the sheet feed section 4 to the secondary transfer section 507. The toner images on the belt surface that are conveyed through the rotation of the intermediate transfer belt 505 are transferred to the sheet in the secondary transfer section 507. The fixing device 510, which is provided with a heating member and a pressing member, fixes the toner image on the sheet by heating and pressing the sheet. The sheet on which the toner image is fixed is sent to the direction of a sheet discharge tray 34 by the sheet discharge roller 520.

The description above is the basic operation of the printing processing in the image forming apparatus 1. Further, the image data to be input to the print section 5 may also be acquired from an external device. In addition, the image forming apparatus 1 according to the embodiment can decolor the toner image formed with the decolorable toner from the sheet. Specifically, the image forming apparatus 1 decolors the toner image using the fixing device 510. The image forming apparatus 1 conveys the sheet printed with the decolorable toner to the fixing device 510. The fixing device 510 heats the conveyed sheet to a temperature above the decoloring temperature of the decolorable toner. Through the heating processing, the color of the toner fixed on the sheet is decolored and thus the toner image is decolored.

Further, in the description of the printing processing described above, in order to facilitate the description, the case of simplex printing is exemplified. In a case of duplex printing, the sheet of which the first surface where the toner image is fixed by the fixing device 510 is to be conveyed to the register roller 506 again through a reverse roller 521. At this time, the sheet is conveyed to the register roller 506 through a conveyance path 522. As a result, the sheet is conveyed to the register roller 506 in a state in which the first surface thereof is opposite to that in the case of the secondary transfer. Then, after the secondary transfer is carried out on the second surface of the sheet, the sheet is to be sent to the direction of the sheet discharge tray 34 by a discharge roller 509. Such a mechanism used for the duplex printing is referred to as a switchback mechanism. Hereinafter, through the preliminary heating (hereinafter referred to as preheating) of the sheet using the switchback mechanism, the image forming apparatus 1 according to the embodiment reduces the fixing temperature of the toner in the color printing.

Figure 2:
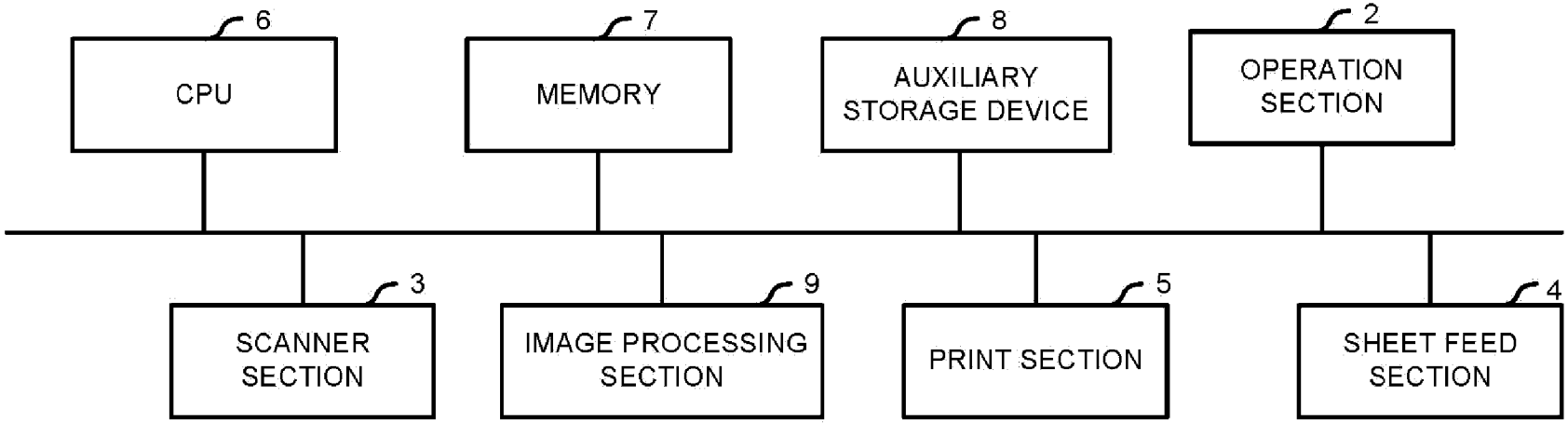
FIG. 2 is a functional block diagram illustrating the functional components of the image forming apparatus 1.

FIG. 2 is a functional block diagram illustrating the functional components of the image forming apparatus 1.

The image forming apparatus 1, which comprises a CPU 6 (Central Processing Unit), a memory 7, an auxiliary storage device 8 and the like connected with each other by a bus, executes an image forming program. For example, the image forming program is stored in the auxiliary storage device 8 in advance, and is read in the memory 7 by the CPU 6. By executing the image forming program, the image forming apparatus 1 functions as an apparatus comprising the operation section 2, the scanner section 3, the sheet feed section 4, the print section 5 and an image processing section 9. Moreover, the whole or part of various functions of the image forming apparatus 1 may be realized using the hardware such as an ASIC (Application Specific Integrated Circuit), PLD (Programmable Logic Device), FPGA (Field Programmable Gate Array) and the like. The image forming program may be recorded in a computer-readable recording medium. The computer-readable recording medium may be, for example, a removable medium such as a flexible disk, a magnetic optical disk, an ROM, a CD-ROM and the like, or a storage device arranged inside the computer system such as a hard disk and the like. The image forming program may be transmitted via a telecommunication line.

The CPU 6 functions as a control section for controlling the operation section 2, the scanner section 3, the sheet feed section 4, the print section 5 and the image processing section 9 by executing the image forming program.

The image processing section 9 executes an image processing in the printing processing. For example, the image processing section 9 converts the image data represented by R, G and B into that represented by Y, M, C and K. In addition, for example, the image processing section 9 carries out image processing such as density correction and color correction on the image data.

Figure 3:
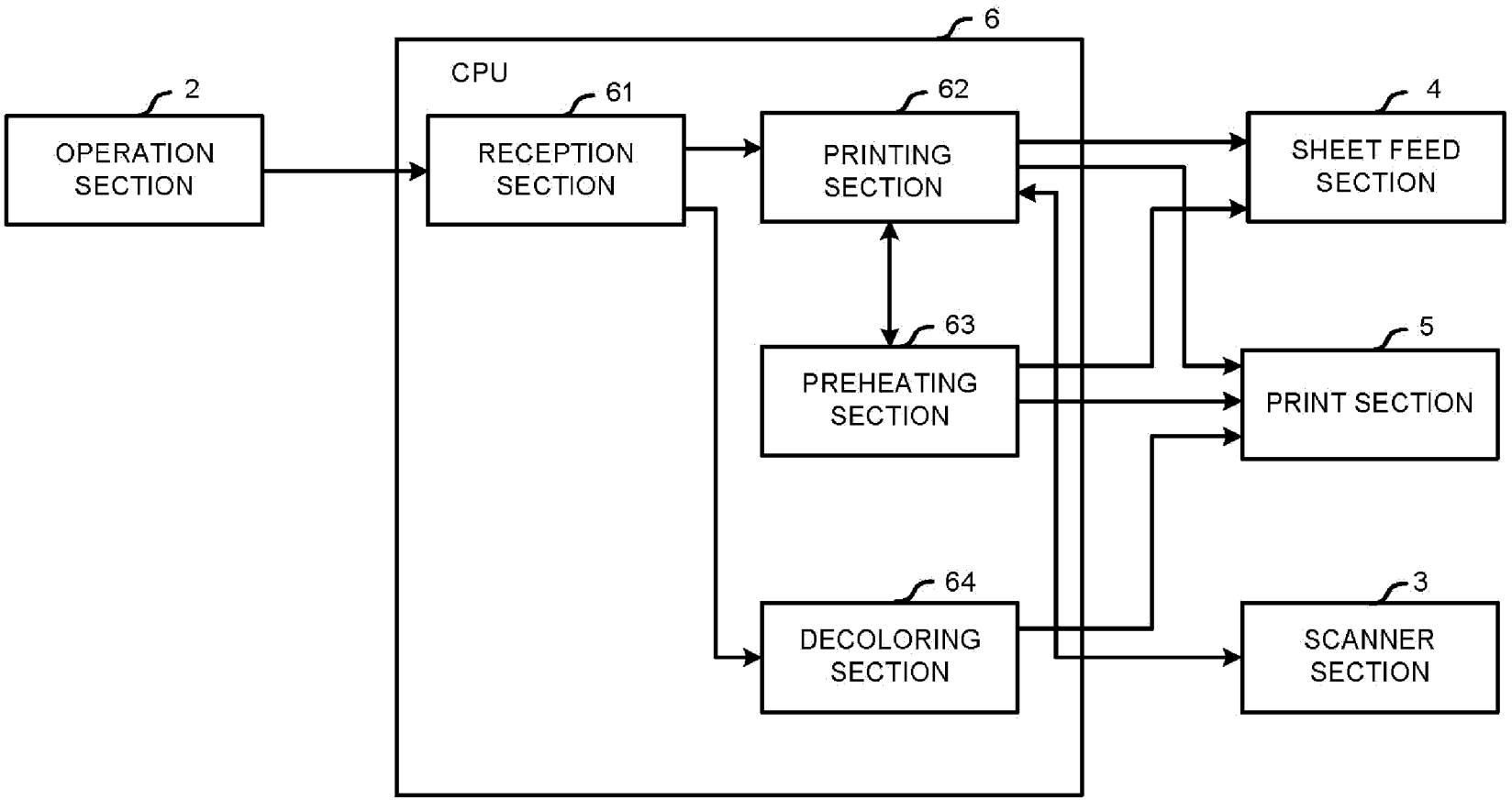
FIG. 3 is a functional block diagram illustrating the functional components of a CPU 6.

FIG. 3 is a functional block diagram illustrating the functional components of the CPU 6.

The CPU 6 is provided with a reception section 61, a printing section 62, a preheating section 63 and a decoloring section 64.

The reception section 61 acquires input information of the user from the operation section 2. The reception section 61 generates a job according to the processing indicated by the input information and controls the execution of the job. A job mentioned herein is a unit of processing executed in response to an execution instruction input by the user. Specifically, in the case in which the input information indicates a printing processing, the input information is output to the print section 62 to instruct the printing section 62 to execute the printing processing. Further, in the case in which the input information indicates a decoloring processing, the input information is output to the decoloring section 64 to instruct the decoloring section 64 to execute the decoloring processing.

The printing section 62 (fixing control section and mode determination section) controls the execution of the printing processing. The printing section 62 instructs the scanner section 3 to read the document to acquire image data from the scanner section 3. The printing section 62 outputs the acquired image data to the print section 5. The printing section 62 instructs the sheet feed section 4 to feed a sheet to the print section 5. The printing section 62 instructs the print section 5 to print the image data on the sheet.

Further, the printing section 62 acquires the input information from the reception 61, and determines the image forming mode based on the input information. The image forming modes, which include a plurality of modes, include a first image forming mode and a second image forming mode. The first image forming mode is an image forming mode used when printing with monochrome decolorable toner. The second image forming mode is an image forming mode used when printing with two or more toners of the decolorable toner and the non-decolorable toner provided in the image forming apparatus 1. The printing section 62 notifies the preheating section 63 of the determined image forming mode.

The preheating section 63 (preheating control section) controls the preheating processing of the sheet according to the image forming mode. If it is determined that the image forming mode is the first image forming mode, the preheating section 63 carries out no preheating processing. If it is determined that the image forming mode is the second image forming mode, the preheating section 63 carries out the preheating processing. The preheating section 63 controls the fixing device 510 to execute the preheating of sheet. The preheating section 63 controls the reverse roller 521 to convey the preheated sheet to the register roller 506. The preheating section 63 informs the printing section 62 that the preheating processing is completed.

The decoloring section 64 controls the decoloring processing of an image printed with the decolorable toner (cyan). The decoloring section 64 controls the fixing device 510 to heat the decoloring target sheet to a temperature above the decoloring temperature of the decolorable toner. The decoloring section 64 controls the discharge roller 509 to discharge the sheet subjected to the decoloring processing to the sheet discharge tray 34.

Figure 4:
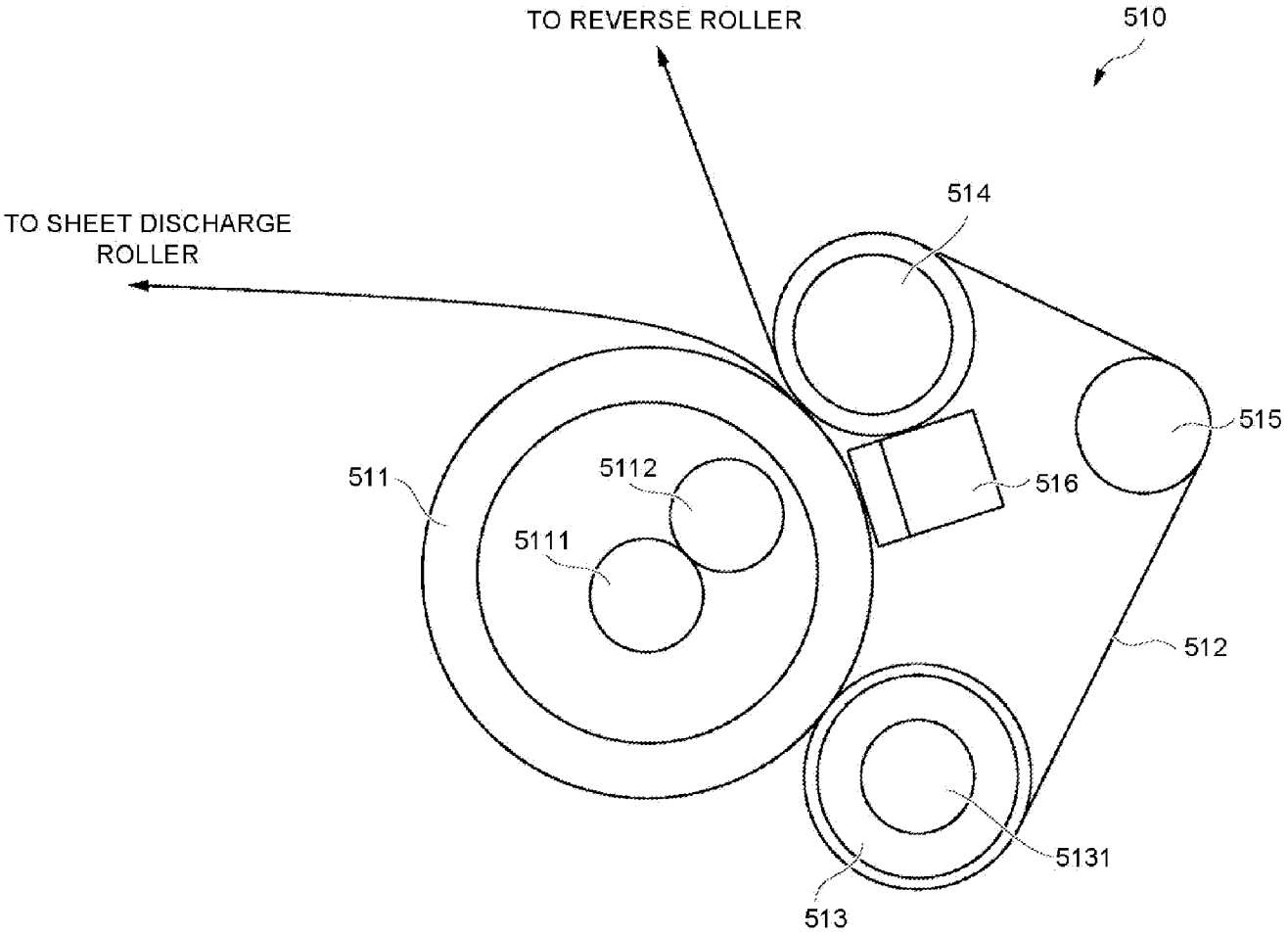
FIG. 4 is a schematic diagram illustrating the constitution of a fixing device 510.

FIG. 4 is a schematic diagram illustrating the constitution of the fixing device 510.

Generally, the fixing device 510 is provided with a heat source member for heating the sheet and a pressing member for pressing the sheet. In the present embodiment, the fixing device 510 comprises a heat roller 511 as the heat source member. Further, the fixing device 510 comprises a fixing belt 512, a fixing belt heat roller 513, an outlet roller 514, a tension roller 515 and a nip pad 516 as the pressing member.

Inside the heat roller 511 is arranged a heater lamp. In the example shown in FIG. 4, the heat roller 511 includes two heater lamps (heater lamp 5111 and heater lamp 5112). For example, the heater lamp 5111 and the heater lamp 5112 are formed by the halogen lamp. The halogen lamp used in the present embodiment is, for example, the one having an output of 300 W per one. The heat roller 511 heats the sheet through the heat supplied by the halogen lamps.

The fixing belt 512, which is a belt used for closely contacting the sheet with the heat roller 511, is stretched by the fixing belt heat roller 513, the outlet roller 514 and the tension roller 515. The fixing belt 512 contacts with the roller surface of the heat roller 511 between the fixing belt heat roller 513 and the outlet roller 514.

Similar to the heat roller 511, inside the fixing belt heat roller 513 is arranged a heater lamp 5131. The fixing belt heat roller 513 heats the fixing belt 512 and conveys the fixing belt 512 to the direction of the nip pad 516.

The outlet roller 514 controls the advancing direction of the sheet to the direction of the sheet discharge roller 520 or the direction of the reverse roller 521. The outlet roller 514 conveys the sheet subjected to the preheating processing to the direction of the reverse roller 521. On the other hand, the outlet roller 514 conveys the sheet subjected to the fixing processing or the decoloring processing to the direction of the sheet discharge roller 520.

The tension roller 515 controls the tension of the fixing belt 512.

The nip pad 516 presses the fixing belt 512 from the inside thereof against the heat roller 511 through an independent pressure mechanism.

Further, it is preferable that the rollers constituting the fixing device 510 have the liquid repellency and the water repellency such that dirt such as water, oil and the like are hardly adhered. In addition, to improve the durability, it is desired that the friction is small and the stress due to rotation is small in each roller. Thus, the surface of each roller may be coated by fluorine resin and the like. For example, the surfaces of the heat roller 511 and the tension roller 515 are coated by the PFA (tetrafluoroethylene perfluoroalkoxy vinyl ether copolymer). Further, for example, the outlet roller 514 may be formed by coating the solid rubber adhered around the metal core with PFA tube. Further, the nip pad 516 may be configured by bonding a silicone rubber to the auxiliary sheet metal.

As described above, the fixing device in which the sheet is pressed against the heat roller using the fixing belt is referred to as a belt type fixing device. In the belt type fixing device, the heat capacity at the heat roller side is large while the heat capacity at the pressure side is small. The pressure side mentioned herein mainly refers to the fixing belt. Therefore, the belt type fixing device is characterized in that the contribution of heat to the pressure side is large from the heat roller side. Then this characteristic is advantageous to reduce the set temperature of the fixing device 510. Further, in the belt type fixing device, the contact width (hereinafter referred to as a "nip width") between a heat roller and a pressure belt is large. Thus, the belt type fixing device has an advantage that the time of heat supply to the sheet is long. Generally, the nip width is 20 mm which is more than three times as wide as that in a roller type fixing device. Though there is a drawback of the large structure, the belt type fixing device has the advantages described above in terms of performance of the heat supply.

Though each functional section of the image forming apparatus 1 is described above, however, the units constituting the functional sections are not limited to the examples of the embodiment. For example, part of or the whole of the functional sections in the image forming apparatus 1 may be integrated as a functional section. For example, the functional sections relating to the processing from reading the document to generating the toner image on the photoconductive drum are configured as an image forming section formed by integrating these functional sections.

Figure 5:
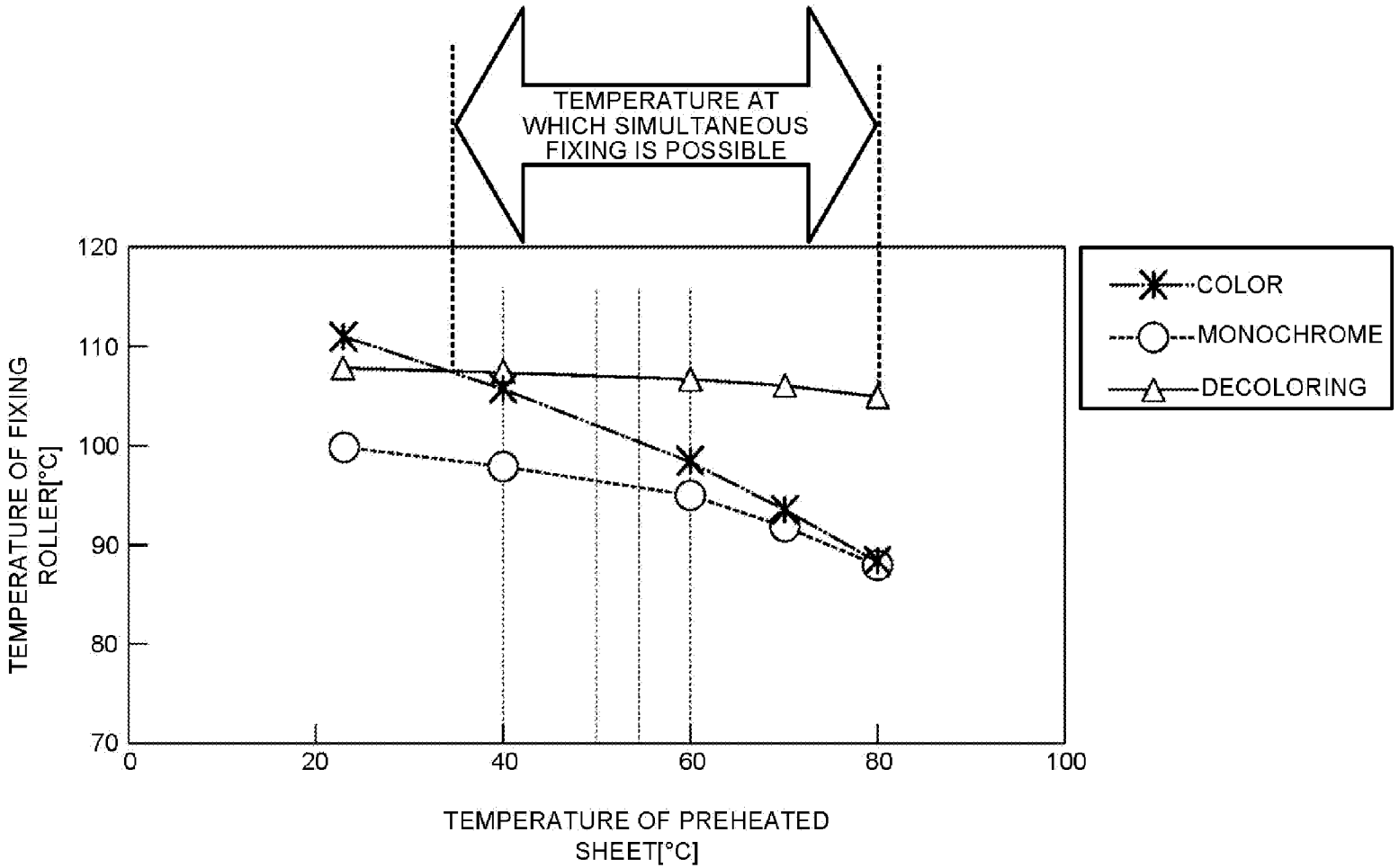
FIG. 5 is a diagram illustrating the reduction of the set temperature according to the preliminary heating of sheet.

FIG. 5 is a diagram illustrating the reduction of the set temperature according to the preheating of sheet.

Among the three series shown in FIG. 5, one series indicates a set temperature in the color printing using multiple kinds of toners. Further, another one series indicates a set temperature in a printing using only a monochrome toner. The rest one series indicates the decoloring temperature of the decolorable toner (cyan). In FIG. 5, the abscissa represents the preheat temperature of the sheet, and the ordinate represents the set temperature for the preheated sheet. As shown in FIG. 5, in general, the fixing temperature of the toner in the color printing is higher than the fixing temperature of the toner in the monochrome printing. This is because in a case of color printing, since the plurality of toners are transferred in layers on the sheet, and a large quantity of heat is required to melt the toner. Thus, as shown in FIG. 5, by preheating the sheet before the toner is transferred thereto, the set temperatures in the color printing and in the monochrome printing are reduced. In the case in which the preheat temperature is 80 degrees centigrade, the set temperature in the color printing and the set temperature in the monochrome printing are comparable. On the contrary, the decoloring temperature is almost constant between 105 degrees centigrade and 110 degrees centigrade. Thus, in this case, by preheating the sheet to a temperature about above 39 degrees centigrade, the decolorable toner and the non-decolorable toner can be fixed at the same time in one fixing processing.

Through the preheating, the printing section 62 can control the set temperature of the fixing device 510 in the color printing at a temperature lower than the decoloring temperature. Specifically, the print section 62 controls the set temperature in such a manner that the temperature of the preheated sheet becomes "a temperature at which the simultaneous fixing is possible" in FIG. 5. In this case, the set temperature in color printing is about 88-100 degrees centigrade. Further, the printing section 62 controls the temperature difference between the set temperature in color printing and the set temperature in monochrome printing to be within a given range. This is because the smaller the fluctuation in temperatures between the color printing and monochrome printing is, the shorter the time required for increasing or reducing the temperature is. As a result, the printing efficiency can be improved. Specifically, the temperature range described above generally is controlled within a range of 20 degrees centigrade. Furthermore, the temperature range is more preferably to be controlled within the range of 10 degrees centigrade. Ideally, it is desired that the temperature difference is 0 degrees centigrade.

Figure 6:
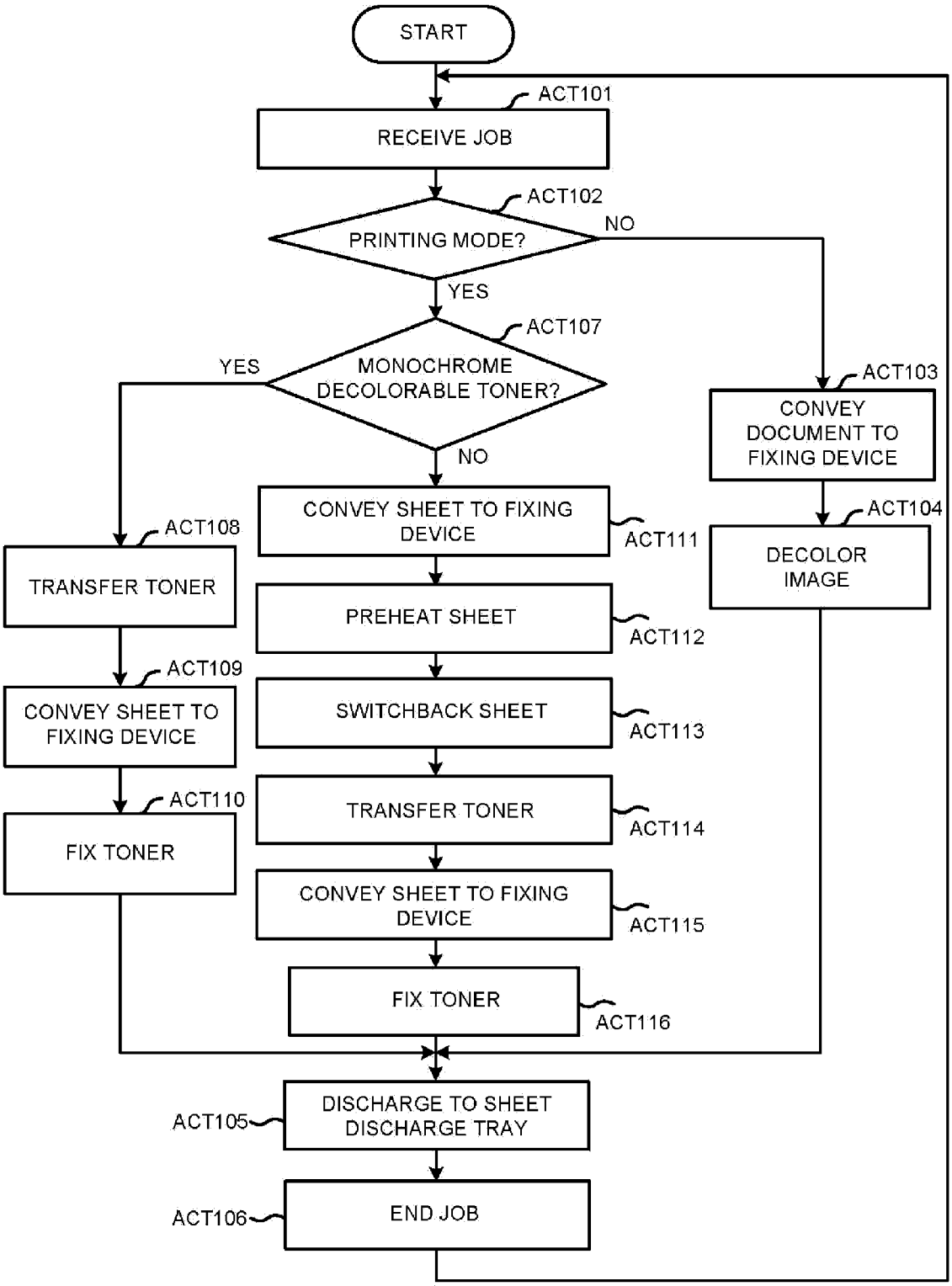
FIG. 6 is a flowchart illustrating the flow of printing processing in the image forming apparatus 1 according to the first embodiment.

FIG. 6 is a flowchart illustrating the flow of the printing processing in the image forming apparatus 1 according to the first embodiment.

First, an execution instruction of a printing processing or a decoloring processing is input by the user from the operation section 2. The reception section 61 manages the processing indicated by the input information with the unit of job. Specifically, the reception section 61 receives the execution of job based on the input information (ACT 101). The reception section 61 determines, according to the input information, whether or not the operation mode is the printing mode (ACT 102). The operation mode is classified into a printing mode carrying out printing and a decoloring mode decoloring an image. In the case in which the operation mode is not the printing mode (NO in ACT 102), the reception section 61 generates a job of decoloring processing and instructs the decoloring section 64 to execute the decoloring processing. The decoloring section 64 controls the print section 5 to execute the decoloring processing. Specifically, the decoloring section 64 controls each roller to convey the document on which the image is to be decolored to the fixing device 510 (ACT 103). The decoloring section 64 controls the fixing device 510 to heat the document to a temperature above the decoloring temperature of the decolorable toner. The decoloring section 64 decolors, through the heating, the color of the decolorable toner on the document to decolor the image (ACT 104). Then, the fixing device 510 sends the sheet subjected to the decoloring processing to the direction of the sheet discharge roller 520. The sheet discharge roller 520 sends the sheet to the sheet discharge tray 34 (ACT 105). The reception section 61 ends the job (ACT 106). The reception section 61 returns to ACT 101 to receive and execute the next job after ending the current job.

On the other hand, if the operation mode is the printing mode (YES in ACT 102), the reception section 61 generates a job of printing processing. Then the reception section 61 instructs the printing section 62 to execute the printing processing. The printing section 62 enables the scanner section 3 to read the document to acquire image data, and then outputs the acquired image data to the print section 5.

Next, the printing section 62 determines the image forming mode based on the input information. Specifically, the printing section 62 determines whether or not the toner used in the printing processing is a monochrome decolorable toner (ACT 107). If it is determined that it is a monochrome decolorable toner (YES in ACT 107), the printing section 62 determines the image forming mode to be the first image forming mode. The printing section 62 outputs the image forming mode to the preheating section 63. In the case in which the image forming mode is the first image forming mode, the preheating section 63 carries out no preheating processing and makes the control return to the printing section 62. Then, the printing section 62 carries out a general printing processing. Specifically, the printing section 62 instructs the sheet feed section 4 to convey a sheet to the print section 5. The printing section 62 instructs the print section 5 to print the image data. The print section 5 transfers the toner to the sheet based on the image data (ACT 108). The print section 5 conveys the sheet to the fixing device 510 (ACT 109). The fixing device 510 fixes the toner on the sheet by heating and pressing the sheet (ACT 110).

On the other hand, if it is determined in ACT 107 that it is not a monochrome decolorable toner (NO in ACT 107), the printing section 62 determines the image forming mode to be the second image forming mode. That is, the second image forming mode includes the following two kinds of printing modes. One mode is a color printing in which a neutral color is represented by using two or more toners of the same type to obtain the color mixing of the toner. The color printing includes not only the color printing based on the non-decolorable toner but also the color printing based on the decolorable toner. The other one mode is a printing mode in which both of the non-decolorable toner and the decolorable toner are used, and the non-decolorable toner and the decolorable toner are used according to the printing area without being mixed. In general, the set temperatures in both of the two printing modes above are high.

The printing section 62 outputs the image forming mode to the preheating section 63. In the case in which the image forming mode is the second image forming mode, the preheating section 63 makes the control return to the printing section 62 after the preheating processing is executed. The printing section 62 carries out a printing processing on the sheet subjected to the preheating processing. Specifically, the preheating section 63 instructs the sheet feed section 4 to convey a sheet to the print section 5. The preheating section 63 instructs the print section 5 to carry out the preheating processing on the sheet. The print section 5 conveys the sheet conveyed from the sheet feed section 4 to the fixing device 510 (ACT 111). At this time, the print section 5 is controlled to be not to carryout the toner transfer process to the sheet. The fixing device 510 preheats the sheet (ACT 112).

In the example shown in FIG. 5, the fixing device 510 preheats the sheet to a temperature about above 39 degrees centigrade so as to fix the toner at a temperature lower than the decoloring temperature. Herein, in the example in FIG. 5, it is assumed that the toner is fixed at the temperature of 101 degrees centigrade. In this case, the preheat temperature of the sheet is about 55 degrees centigrade so as to fix the toner at the temperature of 101 degrees centigrade. If it is considered to reduce the temperature of the sheet before the preheated sheet is conveyed to the fixing device 510 again, it is necessary to preheat the sheet at a further higher temperature. For example, if it is assumed that the image forming apparatus 1 according to the embodiment conveys the sheet at the speed of 136 mm/sec, the fixing device 510 preheats the sheet at the temperature of 105 degrees centigrade. The fixing device 510 sends the preheated sheet to the direction of the reverse roller 521. The reverse roller 521 conveys the sheet to the conveyance path 522. In this way, the print section 5 switches the sheet back to the register roller 506 (ACT 113). The secondary transfer section 507 transfers the toner image to the sheet (ACT 114). After the toner image is transferred, the print section 5 conveys the sheet to the fixing device 510 again (ACT 115). That is, the fixing device 510 preheats the sheet so as to make the temperature of the preheated sheet to which the toner image is to be transferred at the time of arriving at the fixing device 510 be 55 degrees centigrade.

The fixing device 510 heats the sheet through the heat roller 511 that is heated to the set temperature so as to fix the toner on the sheet (ACT 116). In the case in which the sheet is conveyed at the speed of 136 mm/sec, the sheet arrives at the fixing device at about 55 degrees centigrade through the preheating. Thus, the fixing device 510 heats the sheet at, for example, 101 degrees centigrade. Then, the image forming apparatus 1 returns to ACT 101 to receive and execute the next job.

According to the first embodiment, in the case of printing with two or more toners of the decolorable toner and the non-decolorable toner provided in the self-device, the image forming apparatus 1 having the above configuration preheats a sheet before a toner image is transferred thereto. Through the preheating, the set temperature of the fixing device can be reduced to a lower temperature than the set temperature thereof in a case of no preheating. Thus, even in the case in which the image forming apparatus 1 according to the embodiment carries out the printing processing using the decolorable toner and the non-decolorable toner, both the two toners are possible to be fixed at the same time.

Next, a modification of the image forming apparatus 1 according to the first embodiment is described.

In the preheating processing, the preheating section 63 may control one or both of the conveyance speed of sheet and the preheating temperature of sheet. By controlling the conveyance speed of sheet to be faster, the processing time of the printing processing is shorten, and it is possible to further reduce the set temperature. In the case in which the preheat temperature of sheet can be set to be a higher temperature, the conveyance speed of sheet can be reduced.

Further, in the preheating processing of the image forming apparatus 1, the method for heating the sheet is not limited to that using the fixing device 510. For example, the image forming apparatus 1 may be provided with a heat supply device other than the fixing device 510 to carry out the preheating processing of sheet.

A Second Embodiment

Next, an image forming apparatus according to the second embodiment is described. Hereinafter, the image forming apparatus according to the second embodiment is described as an image forming apparatus 1*a*. The physical structure of the image forming apparatus 1*a* is similar to that of the image forming apparatus 1 shown in FIG. 1. Further, the functional components of the image forming apparatus 1*a* are also similar to those of the image forming apparatus 1 shown in FIG. 2. The image forming apparatus 1*a* and the image forming apparatus 1 are different in the control method executed by the CPU. Hereinafter, the CPU of the image forming apparatus 1*a* is described as a CPU 6*a*.

Figure 7:
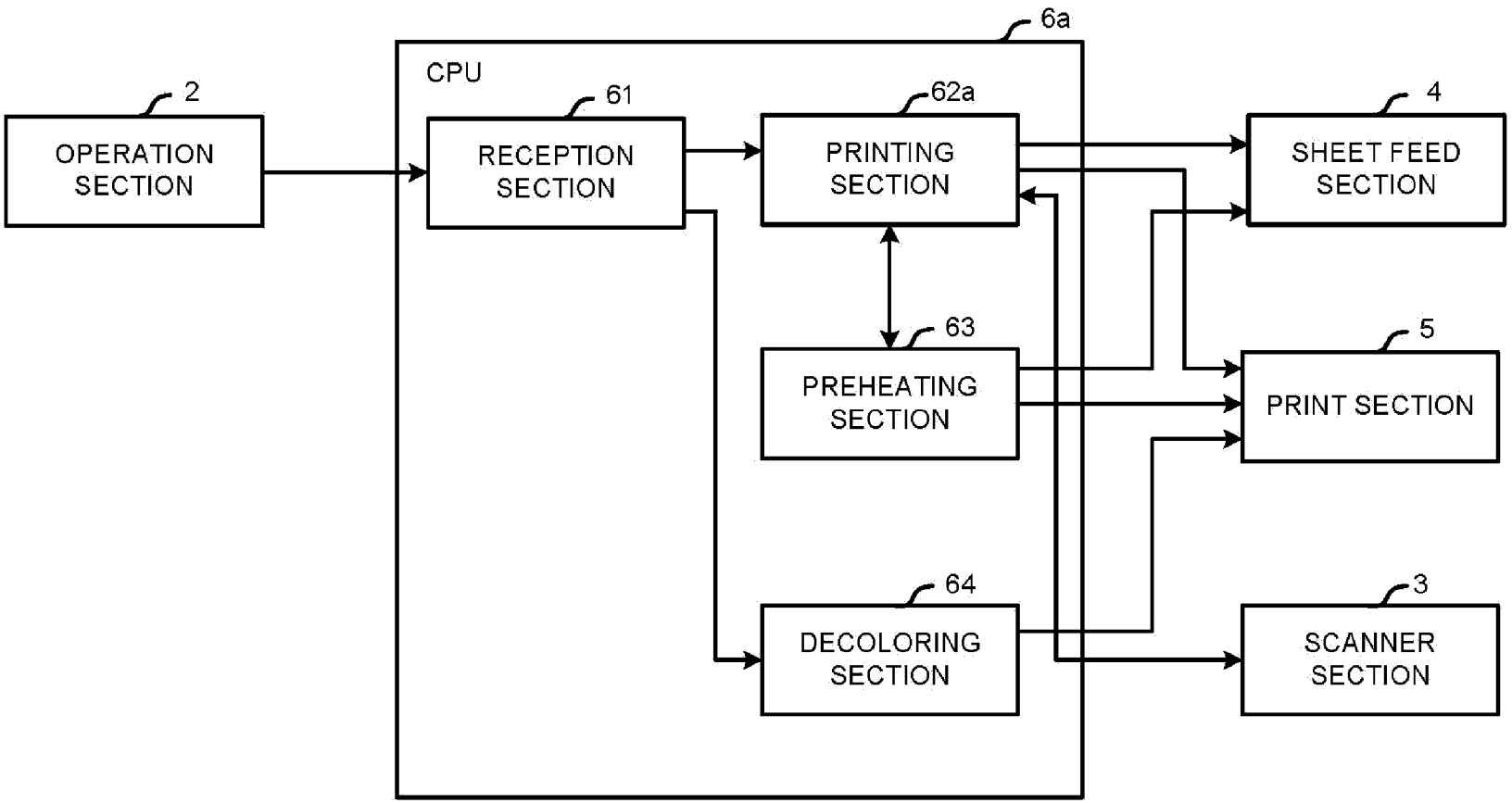
FIG. 7 is a functional block diagram illustrating the functional components of a CPU 6*a*.

FIG. 7 is a functional block diagram illustrating the functional components of the CPU 6*a*.

In FIG. 7, the functional sections similar to those in FIG. 3 are applied with the same reference numerals as those in FIG. 3, and therefore, the description thereof is omitted. The CPU 6*a* is different from the CPU 6 in that it is provided with a printing section 62*a* instead of the printing section 62.

The printing section 62*a* controls the execution of printing processing. Though the printing section 62*a* carries out the same control as the printing section 62, the printing section 62*a* carries out the determination on the image forming mode using a method different from that used by the printing section 62.

Figure 8:
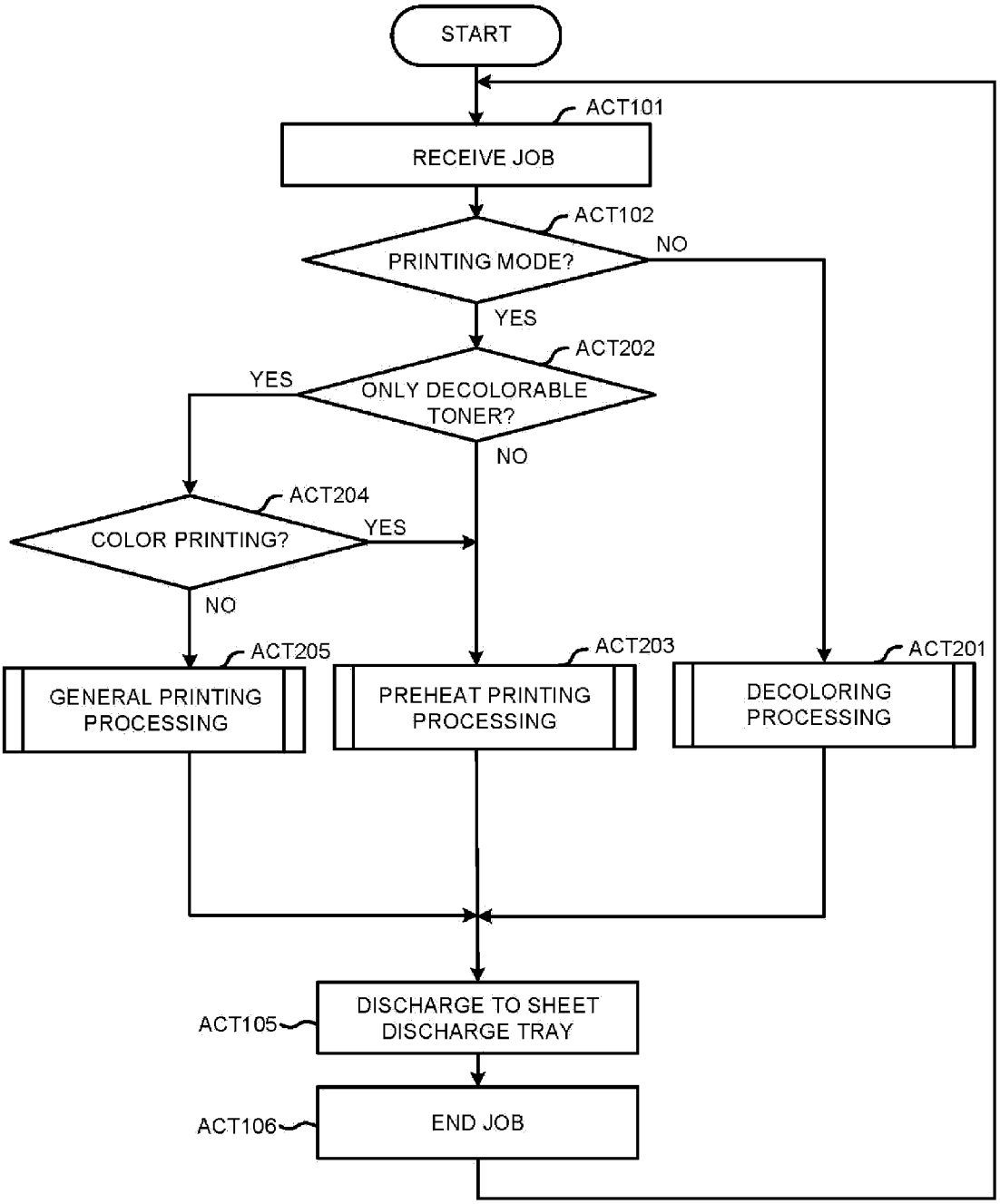
FIG. 8 is a flowchart illustrating the flow of printing processing in an image forming apparatus 1*a* according to a second embodiment.

FIG. 8 is a flowchart illustrating the flow of the printing processing in the image forming apparatus 1*a* according to the second embodiment.

In FIG. 8, the same processing as those in FIG. 6 are applied with the same reference numerals, and therefore, the description thereof is omitted. Further, ACT 103 and ACT 104 in FIG. 6 are collectively referred to as a decoloring processing in FIG. 8. The decoloring processing is represented by ACT 201. Similarly, ACT 111-ACT 116 in FIG. 6 are collectively referred to as a preheat printing processing in FIG. 8. The preheat printing processing is represented by ACT 203. Similarly, ACT 108-ACT 110 in FIG. 6 are collectively referred to as a general printing processing in FIG. 8. The general printing processing is represented by ACT 205.

First, in the case in which the operation mode in ACT 102 is not the printing mode (NO in ACT 102), the reception section 61 generates a job of decoloring processing and instructs the decoloring section 64 to execute the decoloring processing. The decoloring section 64 controls the print section 5 to execute the decoloring processing (ACT 201).

On the other hand, in the case in which the operation mode is the printing mode (YES in ACT 102), the reception section 61 generates a job of printing processing. Then, the reception section 61 instructs the printing section 62*a* to execute the printing processing. The printing section 62*a* enables the scanner section 3 to read the document to acquire image data, and then outputs the acquired image data to the print section 5.

Next, the printing section 62*a* determines whether or not the toner used in the printing processing is only the decolorable toner based on the input information (ACT 202) If it is determined that it is not only the decolorable toner (NO in ACT 202), the printing section 62*a* determines the image forming mode to be the second image forming mode. The printing section 62*a* outputs the image forming mode to the preheating section 63. The image forming apparatus 1*a* carries out a preheat printing processing based on the image forming mode (ACT 203). On the other hand, in the case in which only the decolorable toner is used (YES in ACT 202), the printing section 62*a* determines the type of printing processing. Specifically, the printing section 62*a* determines whether or not the type of printing processing indicated by the input information is color printing (ACT 204).

If the type of printing processing is color printing (YES in ACT 204), the printing section 62*a* determines the image forming mode to be the second image forming mode. The printing section 62*a* outputs the image forming mode to the preheating section 63. The image forming apparatus 1*a* carries out the preheat printing processing based on the image forming mode (ACT 203). On the other hand, if the type of printing processing is not color printing (NO in ACT 204), the printing section 62*a* determines the image forming mode to be the first image forming mode. The image forming apparatus 1*a* carries out a general printing processing based on the image forming mode (ACT 205).

According to the second embodiment, in the case of carrying out color printing, the image forming apparatus 1*a* having the configurations above preheats a sheet before a toner image is transferred thereto. Through the preheating, the set temperature of the heat roller 511 can be reduced to a lower temperature than the set temperature thereof in a case of no preheating. When printing with decolorable toner following the color printing, it is necessary to wait until the temperature of the fixing device reduces in the past. However, in the image forming apparatus 1*a* according to the embodiment, the fixing device 510 fixes the toner at a set temperature at which the color of the decolorable toner will not be decolored. Thus, in the image forming apparatus 1*a*, after the color printing is carried out, the printing with the decolorable toner can be carried out without waiting until the temperature of the fixing device 510 reduces.

Furthermore, even if it is not a case of color printing but a case of printing with both of the decolorable toner and the non-decolorable toner, the image forming apparatus 1*a* according to the embodiment carries out the preheating of sheet. In this way, in the case in which both the decolorable toner and the non-decolorable toner are used, it is possible for the image forming apparatus 1*a* according to the embodiment to fix the two toners at the same time.

In this embodiment, "decoloring" means to make it difficult to recognize a color of an image formed on an image receiving member after the image is formed on the image receiving member by a recording material which has different color from the color of the image receiving material. The color of recording material may be achromatic color including black or white, not limiting to chromatic color. In addition, "decoloring the image" means "erasing the image".

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus which forms an image according to an image forming mode, comprising:

an image forming section configured to include at least one decolorable toner and at least one non-decolorable toner, and form a toner image selectively using the decolorable toner and the non-decolorable toner;

a transfer section configured to transfer the toner image formed by the image forming section to a sheet;

a fixing section configured to fix the toner image on the sheet by heating and pressing the toner image;

a fixing control section configured to control a set temperature of the fixing section;

a mode determination section configured to determine, from a plurality of image forming modes including a first image forming mode in which a toner image is formed on a sheet with one decolorable toner and a second image forming mode in which a toner image is formed on a sheet with two or more toners of the decolorable toner and the non-decolorable toner, a designated image forming mode; and a preheating control section configured to execute preheating of the sheet before image formation in the second image forming mode, and execute no preheating of the sheet before image formation in the first image forming mode.

2. The image forming apparatus according to claim 1, wherein the preheating control section preheats the sheet with the fixing section.

3. The image forming apparatus according to claim 2, wherein the preheating control section preheats the sheet before a toner image is transferred to the sheet by the transfer section.

4. The image forming apparatus according to claim 3, wherein the preheating control section conveys the sheet preheated by the fixing section to the transfer section; and the transfer section transfers a toner image to the preheated sheet.

5. The image forming apparatus according to claim 4, wherein the fixing control section fixes the toner at a set temperature lower than a set temperature in the first image forming mode on the preheated sheet.

6. The image forming apparatus according to claim 5, wherein the preheating control section controls a set temperature in the second image forming mode to a temperature within a given range from the set temperature in the first image forming mode.

7. The image forming apparatus according to claim 6, wherein the mode determination section determines an image forming mode to be the first image forming mode in the case in which the printing using only decolorable toner is not a color printing.

8. The image forming apparatus according to claim 7, wherein the preheating control section controls the conveyance speed of the sheet such that the preheated sheet arrives at the transfer section at a specific temperature.

9. A control method carried out by an image forming apparatus which forms an image according to an image forming mode, including:

including at least one decolorable toner and at least one non-decolorable toner, and forming a toner image selectively using the decolorable toner and the non-decolorable toner;

transferring the formed toner image to a sheet;

fixing the toner image on the sheet by heating and pressing the toner image;

controlling a set temperature of the fixing section;

determining, from a plurality of image forming modes including a first image forming mode in which a toner image is formed on a sheet with one decolorable toner and a second image forming mode in which a toner image is formed on a sheet with two or more toners of the decolorable toner and the non-decolorable toner, a designated image forming mode; and executing preheating of the sheet before image formation in the second image forming mode while executing no preheating of the sheet before image formation in the first image forming mode.

* * * * *